United States Patent [19]

Jordense

[11] Patent Number: 4,621,944

[45] Date of Patent: Nov. 11, 1986

[54] RAPID REPAIR OF RUNWAYS

[75] Inventor: Antonius P. M. Jordense, Elst, Netherlands

[73] Assignee: 501 Bruil-Arnhem Groep B.V., Netherlands

[21] Appl. No.: 677,083

[22] Filed: Nov. 30, 1984

[30] Foreign Application Priority Data

Nov. 7, 1983 [NL] Netherlands ..... 8304230

[51] Int. Cl.[4] ..... E01C 19/15; E01C 5/10; E01C 19/50

[52] U.S. Cl. ..... 404/75; 404/72; 404/96; 404/118

[58] Field of Search ..... 404/118, 119, 75, 96, 404/72, 73, 120, 34; 172/780, 23; 280/111

[56] References Cited

U.S. PATENT DOCUMENTS

| | | | |
|---|---|---|---|
| 2,094,910 | 10/1937 | Baily | 404/96 |
| 3,182,410 | 5/1965 | Schiavi | 404/96 X |
| 3,199,422 | 8/1965 | Rees, Jr. | 404/73 |
| 3,435,740 | 4/1969 | McGall | 404/119 X |
| 3,716,105 | 2/1973 | Hallam | 172/799.5 |
| 3,915,582 | 10/1975 | Clarke | 404/75 |
| 4,364,690 | 12/1982 | Bruns | 404/118 |
| 4,404,244 | 9/1983 | Springston | 428/109 |

FOREIGN PATENT DOCUMENTS

| | | | |
|---|---|---|---|
| 1907164 | 7/1978 | Fed. Rep. of Germany | 280/111 |
| 2102054 | 1/1983 | United Kingdom . | |

*Primary Examiner*—Stephen J. Novosad
*Assistant Examiner*—Matthew Smith
*Attorney, Agent, or Firm*—John P. Snyder

[57] ABSTRACT

A method and apparatus for performing rapid repair of a crater-damaged aircraft runway. The surface level area of the crater is first enlarged to a predetermined rectangular area within which a plurality of concrete tiles of a standard area will fit contiguously to cover the area. The crater is filled with material. The contour of the runway leading up to the area is conformed to by a series of end-to-end scraper blades of widths equal to that of the tiles, the blades are lifted en masse and traveled to an edge of the rectangular area where they are lowered thereinto to a depth below the undamaged surface equal to the thickness of a tile. The device is then traveled to the other end of the area while striking off the fill material to provide a smooth, even surface upon which the tiles are laid.

14 Claims, 5 Drawing Figures

RAPID REPAIR OF RUNWAYS

BACKGROUND OF THE INVENTION

This invention is directed to the rapid repair of aircraft runway surfaces during times of hostility. Of principal concern under these conditions is the ability to restore the landing, take-off surface to usable form in as little time as possible while achieving, at the same time, a repaired surface which meets the conditions or standards of the original surface as closely as possible. This requires the repaired surface to be provided by material, such as concrete, which at least matches the quality of the original surface.

BRIEF SUMMARY OF THE INVENTION

The invention is concerned with method and apparatus for rapid repair of crater-damaged aircraft runways. By rapid repair is meant restoration of the runway to usable condition within the time of a few hours. Basically, the restoration to usable condition involves the resurfacing of the damaged area of the runway with prefabricated tiles, preferably those which are in the form of reinforced concrete and are readily available as items of commerce.

The method, in general, involves cutting through the existing runway surface around a crater to form the outlines of a rectangular area encompassing the crater, filling in the crater with suitable filling material which may, in large part, be rubble or like material in the general area of the damage and which in all probability would include material excavated by the shell or bomb which created the crater. Preferably, the mound of material within the crater and covering the area of the rectangular area includes a top layer of material such as dirt or sand which is readily struck-off or screeded to form a relatively smooth and even top surface. For forming this surface, the method involves conforming a plurality of end-to-end strike-off blades whose lower edges define a substantially continuous strike-off edge having a contour conformed to the undamaged surface of the runway leading to the rectangular area, raising these blades en masse so as to preserve such contour of the strike-off edge and maintain it parallel to the surface to which it was conformed, advancing the blades over one end of the rectangular area and lowering such strike-off edge to a level which is a predetermined distance below the level of the undamaged surface, then advancing the blades to strike off the fill material and define a relatively smooth and even top surface within the rectangular area, and then filling in the rectangular area with a plurality of contiguous tiles whose upper surfaces define a substantially smooth continuation of the undamaged surface.

The invention is also directed to apparatus for determining the contour of the undamaged surface of the runway leading up to the crater through the medium of a plurality of end-to-end striker blades and position adjusting means connecting the opposite ends of each blade to a carrier for independent vertical adjustment to fixed locations relative thereto. The lower edges of the blades are individually adjusted so that the lower edges of the blades form a strike-off edge or line which conforms as closely as possible to the contour of the undamaged surface. The carrier is movably supported at its opposite ends and adjusting means are located thereat for raising the carrier and the blades en masse to allow transport over the undamaged surface and subsequent lowering of the conformed strike-off edge into the rectangular area of the crater to that depth substantially equal to the thickness of a tile.

BRIEF DESCRIPTION OF THE DRAWING FIGURES

DETAILED DESCRIPTION OF THE INVENTION

Figure 1:
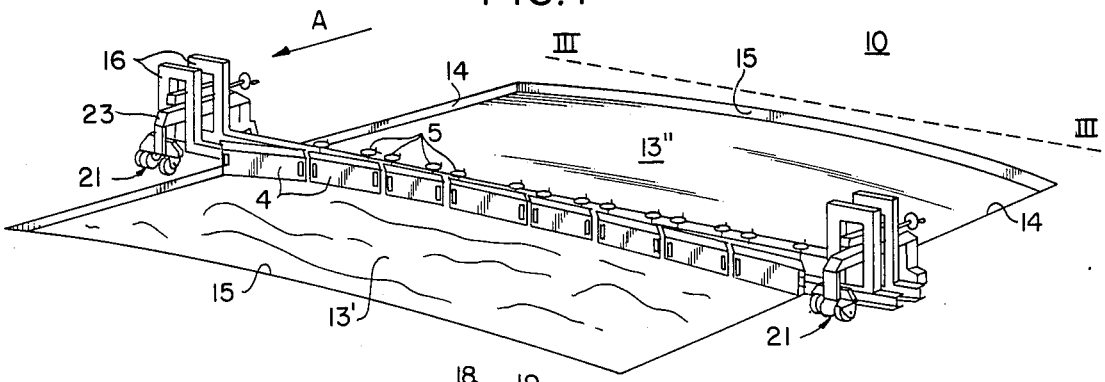
FIG. 1 is a diagrammatic, perspective view of a movable apparatus according to the invention during the strike-off operation at a crater being repaired.
Figure 5:
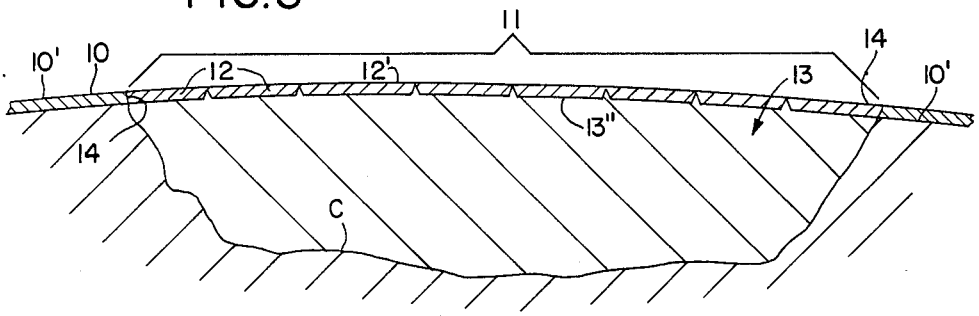
FIG. 5 is a vertical cross section through a part of a runway in which a number of runway slabs have been fitted to effect the rapid repair.
Figure 2:
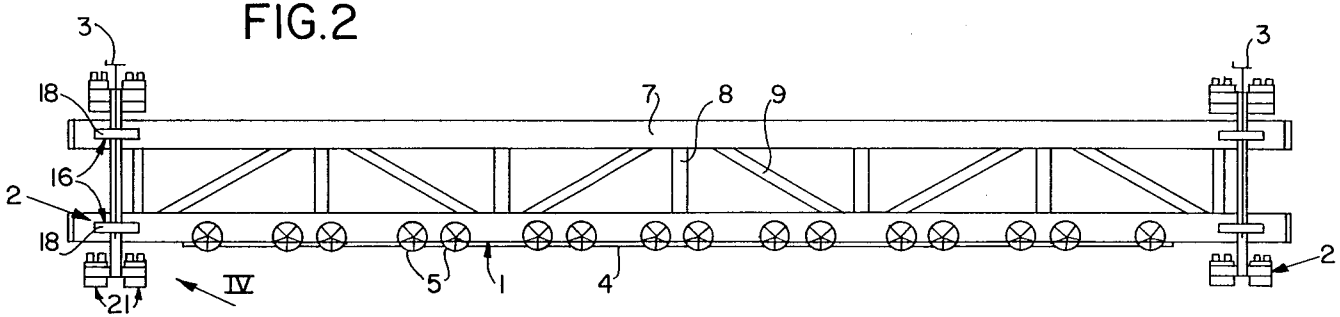
FIGS. 2 and 3 are respective top plan and front elevational views diagrammatically illustrating the strike-off apparatus according to this invention.
Figure 3:
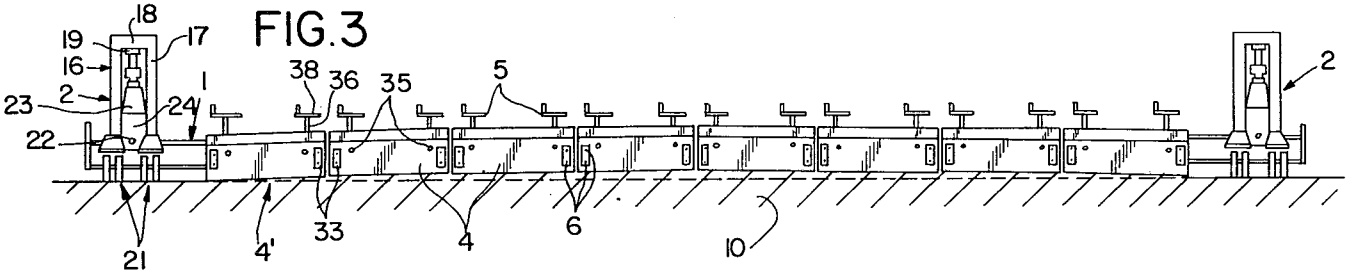

The method according to the present invention is best described in conjunction with FIGS. 1, 3 and 5. In FIG. 5, the aircraft undamaged runway surface 10 is shown to have been damaged by the crater C which renders the runway unusable for its intended purposes of providing a landing and take-off area or surface for aircraft. The surface 10 may be and usually is cambered as illustrated in Figure 5. FIG. 5 also illustrates the fill material 13 which has been used to fill a purposely enlarged crater whose area at the undamaged runway surface 10 has been increased to the rectangular area defined between the parallel side longitudinal edges 14, 14 and the parallel widthwise end edges 15,15. These edges are formed by cutting through the undamaged runway surface 10. The surface 10 is provided by a layer 10' of concrete or other material suitable for the purposes intended and the edges 14,15 are provided by cutting through and removing the material 10' so as to enlarge or expand the plan view area of the original crater C to a rectangular area of predetermined width and length surrounding or encompassing the crater C. In FIG. 5, the widthwise dimension of the expanded rectangular area is designated by the reference character 11. This dimension 11, as well as the longitudinal dimension between the edges 15,15. (see FIG. 1) are even multiples of the respective width and length of a tile 12.

The enlarged crater is then filled with fill material 13 in amount sufficient so that the level of its top player 13' (FIG. 1) is near the level of the undamaged surface 10. Thereafter, this fill material is struck-off to a depressed level 13" by apparatus of this invention which provides a depressed contour of the fill material which is parallel to but below the level of the surface 10 which leads up to the aforesaid rectangular area. Then, the tiles 12 are laid in place to cover the surface 13" completely and therefore provide a repaired runway surface 12' which is substantially at the same level and of the same contour as the undamaged surface 10 leading up to the rectangular area.

The manner in which this depressed contour is formed will be evident from FIG. 3. As shown therein, an elongate carriage means 1 is supported adjacent its opposite ends by the movable support means 2,2 which are supported on the undamaged runway surface 10 which leads up to one of the cut-through edges 15 defining one end of the aforesaid rectangular area. The carriage means 1 maintains a plurality of strike-off plates or blades 4 in end-to-end relation by means of guide plates 33 at the opposite ends of each plate and associated guide pin means 6. Each plate is connected through position adjusting means 5 adjacent each end of the plates 4 to impart independent up and down adjustment to each such end of a blade or plate. Since the means 5 impart independent adjustments to the opposite ends of each blade 4, and holds it so adjusted, the lower or strike-off edge of each blade is adjustable not only as to its height but also as to its inclination to the horizontal. In FIG. 3, these lower edges 4' are shown adjusted so that they contact the undamaged surface 10 and define a substantially continuous strike-off edge which conforms generally to the transverse contour of the runway surface 10 leading up to that edge of the rectangular area defined by said one cut-through edge 15 of the rectangular area. After so conforming the lower edges 4' of the plates 4 to such contour, the entire carriage means 1 is raised by the adjusting means 3 on the two movable support means 2 so that the contoured strike-off edge defined by the lower edges 4' are above the level of the surface 10. The strike-off apparatus of the invention is then advanced by any suitable means until such lower edges 4' are just beyond said one end 15 of the rectangular area and then the carriage means is lowered by the adjusting means 3 on the movable support means 2 until the lower edges 4' are positioned below the level of the undamaged runway surface 10 by that amount substantially equal to the thickness of the tiles 12 and to such amount for each adjusting means 3 at the opposite ends of the carriage as assures that the contour defined by the lower edges 4' is substantially parallel to the undamaged runway surface 10 to which they have been conformed, as aforesaid.

The apparatus of this invention is then moved longitudinally as indicated by the arrow A in FIG. 1 so that the lower edges 4' strike-off the fill material 13' to provide the depressed contour 13'' which is substantially parallel to but depressed with respect to the undamaged surface 10 leading up to the rectangular area. When the blades 4 of the apparatus reach the other end edge 15, the carriage with the blades 4 are then raised to allow the apparatus to be moved beyond the rectangular area and thereafter the tiles 12 are laid.

It will be appreciated that the size of the rectangular area is controlled so as just to encompass the damaged region of the runway within the rectangular area defined by the smallest number of tiles. Thus, one or more of the blades 4 may not be required, in which case they are simply raised above the level of the other blades so that they do not contact the undamaged runway surface 10 above which they sweep as the strike-off by the other blades is effected.

The fill material 13 may consist of locally available material such as rubble or debris from the crater C but preferably includes a top layer of material such as dirt or sand which provides a smooth and even struck-off surface 13''. The fill material below such top layer may be compacted by any suitable and conventional means.

Figure 4:
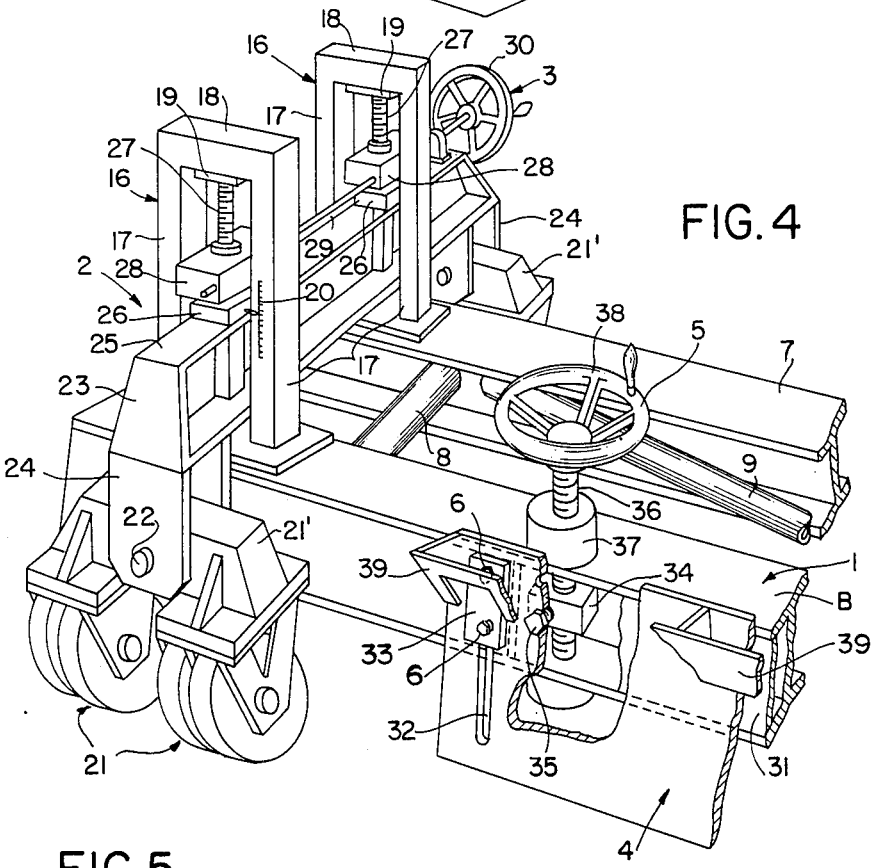
FIG. 4 illustrates certain details of the carrier body and associated assembly in enlarged, perspective fashion.

As will be apparent from FIG. 4, in the embodiment described, the carrier body 1 is substantially in the form of an I-beam B which in order to increase the resistance to flexure is connected via tubular prop members 8 and tension members 9 to parallel member 7 which is also in the form of an I-beam. Unless otherwise shown in FIG. 4, all the fixed connections between the various parts of the apparatus are formed by welding.

The carrier beam B and the parallel member 7 are supported at their two ends by respective roller assemblies 2, one of which is shown in FIG. 4. It will be apparent that the roller assemblies 2 should be constructed for movement of the apparatus in the direction of the arrow A in FIG. 1, i.e., straddling the rectangular area beyond the longitudinal edges 14 as shown in FIG. 1. In the embodiment shown in FIG. 4, the roller assembly 2 has two wheel sets 21 both at the front and the back of the apparatus, each set of wheels being carried by a beam 21' adapted to perform a rocking movement about a spindle 22. The downwardly directed limbs 24 of each U-shaped yoke 23 are connected by the spindles 22 to the two wheels sets 21 and the spindles 22 lie on a common axis perpendicular to the length of the carrier 1. The top member 25 of the yoke also extends in the direction of movement of the apparatus and carries two nut members 26 shown diagrammatically in FIG. 4, which are welded fast to the top member 25 and cooperate with two screw spindles 27 which, as will be explained hereinafter, are so mounted respectively on the carrier I-beam B and the parallel member 7 as to be freely rotatable with respect to their associated member but unable to perform any longitudinal movement. Gearboxes 28 extend respectively around the screw spindles 27 above the nut members 26 and are coupled to one another via a shaft 29 which in the embodiment described here can be rotated manually by a handwheel 30 although it would be possible for it to be motor-driven. The said components 26–30 together form the adjusting means already referred to, which are used to adjust the relative level of the carrier body 1 relative to the supporting surface 10. In FIG. 4, the adjustment is such that the carrier body 1 is supported by the roller assemblies 2 at a level at which the bottom edges 4' of the scraping plates 4 carried by the carrier body 1 are clear of the ground surface (not shown in FIG. 4) on which the roller assembly 2 rests. In that case the apparatus can be moved freely over the ground surface, e.g., the runway surface portion 10 shown in FIG. 1. The device may be motorized to effect this movement or it may be towed.

With regard to the screw spindles 27 forming part of the adjusting means 3 it has already been stated that these are mounted to be freely rotatable. The screw spindles 27, whose length is so selected that relative level of the carrier body 1 and the roller assemblies 2 can be brought to the value required at any time during operation, are for this purpose contained inside inverted U yokes 16, the limbs 17 of which are welded fast at their feee ends to the beam B and the parallel member 7 respectively and the respective crossmembers 18 carry respective top bearings 19 for the screw spindles 27. In FIG. 4, one of the scale graduation 20 is shown on one of the limbs 17 of the front yokes 16 to show how the strike-off edge 4' can be correctly positioned within the confines of the crater. After the conformation, readings on the scales are taken, the carriage raised and the apparatus moved to the rectangular area, and the carriage is lowered to the proper readings on the scales 20 so that the strike-off edge 4' lies at a depressed level below the undamaged surface by that amount which is equal to the thickness of a tile.

The way in which the scraping members in the form of plates 4 in the embodiment here described are connected to the carrier body 1 and can be adjusted in respect of their level relative thereto will now be described.

The embodiment here described comprises scraping plates 4 each having a length of 2 m in the longitudinal direction of the carrier body 1 and each connected thereto near its two ends. For this purpose, plates 31 are welded at relevant places between the flanges of the I-section carrier body 1 facing the front of the apparatus, and have internally tapped holes to receive the guide pin means 6 at the locations (not visible in the drawing) corresponding to said means 6 in FIG. 4. In the embodiment shown, each scraping plate 4 has vertical slots 32 of a width greater than the shank diameter of the bolts or pin means 6. Consequently, each scraping plate 4 is guided relative to the carrier body 1 by means of four bolts 6 extending respectively in two's through the two slots 32 so that, with respect to the carrier body, the plates are allowed not only to move purely in a vertical sense but also to move in a rotational sense. The rotational movement is limited by the lateral clearance of the bolts in the slots 32 whereas the purely vertical movement is limited by the lengths of the slots 32. This leads to the possibility, which is clearly visible in FIG. 3, of bringing the different scraping plates 4 into such different vertical and rotational positions with respect to the carrier body 1 that the bottom edges 4' of the plates 4 can follow or conform to any required roadway or runway profile. From the outside the bolts 6 do not extend directly through a slot 32 but first through respective guide plates 33. The heads of the bolts serve to hold the guide plates 33 lightly against the blades 4 and thereby to permit the aforesaid movements of the blades relative to the carrier 1.

It should be noted that the described construction with the bolts 6 and the nut plates 31 secured to the carrier body 1 can be replaced by a different construction for the connection between the scraping plates 4 and the carrier body 1; for example, the plates 31 or 33 can carry outwardly projecting pin ends which pass through the slots 32 and associated holes in the plates 33 or 31 respectively to receive nuts, which, as above, allow adjustment so that the pins hold the blades lightly sandwiched between the plates 31, 33.

It will also be apparent that the connection described by means of the bolts 6 or the like between the scraping plates 4 and the carrier body 1 offers sufficient possibilities of bringing the different scraping plates 4 into their respectively required positions relative to the carrier body 1. In the movable apparatus according to the invention, this adjustment of the scraping plates 4 is carried out by position adjusting means 5 which will now be described in detail.

A nut member 34 is disposed near a nut plate 31 between the flanges of the I-section carrier body 1 and, on the one hand, is connected by a bolt 35 to the associated end of the scraping plate and, on the other hand, can perform a solely vertical movement between the two flanges along a screw spindle 36 supported to be freely rotatable by means of bearings 37 at the two flanges of the carrier body 1, and having a handwheel 38 at the top. The parts 34–38 referred to above, of which one set is disposed near each longitudinal end of a scraping plate 4, form the said position adjusting means 5. It will be apparent that these adjusting means allow a very accurate determination of the position of each scraping plate 4 relative to the carrier body 1. The use of position adjusting means operating by means of a screw spindle 36 and capable of rapid adjustment with the aid of the associated handwheels 38 is found very satisfactory in practice. Depending upon practical conditions, of course, some other way of energizing the position adjusting means can be used, e.g. electric motor or hydraulic means so long as the position adjusting means serves the function of effecting and holding the requisite vertical and rotational movements of the scraping blades.

In FIG. 4, in order to show the above-mentioned nut body 34 and the part of the screw spindle 36 extending between the flanges of the carrier body 1, part of the scraping plate 4 is cut away; the same applies to a deflector plate 39 disposed on the top of the scraping plate 4 and visible on either side of the cut-away part of the scraping plate 4 in FIG. 4. This deflector plate serves to prevent base layer material which may accumulate at the front of the plate 4 during operation from being pushed to above the carrier body 1 and dropping over the same. This problem may occur particularly if the scraping plates 4 are not disposed in a purely vertical plate as shown in FIG. 4 but are disposed to project obliquely forwards at the bottom to some extent, something which may be advisable in some cases. It should be noted that the deflector plate 39 can only be in the form of a separate plate disposed at or near the top of a scraping plate 4, but can also be formed by the top of the scraping plate 4 which, in that case, will be bent over in the direction of movement of the apparatus.

As will be apparent from the description, the invention provides a movable apparatus for forming a profiled base layer, the apparatus carrier body supported at its ends by wheel or roller assemblies being provided with a number of successive scraping means in the longitudinal direction of the carrier body, the respective levels of said scraping means relative to the carrier body being adjustable. This gives the possibility of forming a profiled base layer having the same camber as that of an existing runway or roadway. The appratus is particularly suitable for the rapid repair of a damaged runway or a damaged roadway.

The invention is not restricted to the embodiment described hereinbefore and illustrated in the drawing; various amendments may be made in respect to the details described and their interrelationships without thereby departing from the scope of the invention.

What is claimed is:

1. The method of making rapid repair of a crater-damaged aircraft runway, which comprises the steps of:

(a) enlarging the surface level area of the damaged surface in surrounding relation to the crater-damaged region of the runway to form an an enlarged crater whose surface level area is enlarged to a rectangular area of predetermined width and length;

(b) filling in the enlarged crater with fill material in amount sufficient to fill in said enlarged crater to a level near that of the undamaged surface;

(c) conforming to and preserving the contour of the undamaged runway surface leading to said rectangular area and striking off fill material from within the rectangular area to define a depressed contour of fill material within said rectangular area conformed to and parallel with the contour of the undamaged surface leading to said rectangular area; and (d) laying tiles in contiguous relationship to one another onto said depressed contour of the fill material to completely cover said rectangular area and provide a repaired landing surface area therewith which is at substantially the same level and contour as said undamaged surface leading to the rectangular area.

2. The method as defined in claim 1 wherein the width and the length of said rectangular area each is an even multiple of the respective width and length of a tile.

3. The method of making rapid repair of a crater-damaged aircraft runway, which comprises the steps of:

(a) removing the undamaged surface of the runway surrounding the damage to form an enlarged crater within a rectangular area of undamaged runway which is of predetermined width and length;

(b) filling in the enlarged crater with fill material in amount sufficient to fill in said enlarged crater to a level near that of the undamaged surface;

(c) conforming the lower edges of a plurality of end-to-end similar strike-off blades to the widthwise contour of the undamaged surface leading to said rectangular area and then raising such blades above the undamaged surface while preserving such contour and moving the blades to one longitudinal end of said rectangular area;

(d) lowering said blades into said rectangular area at said end thereof to a level below the undamaged surface while preserving said contour and then moving such blades toward the other end of said fill material parallel to said contour of the undamaged runway to which said lower edges have been conformed in step (c); and (e) laying tiles in contiguous relationship to one another onto said depressed contour of the fill material to completely cover said rectangular area and provide a landing surface area therewith which is at substantially the same level and contour as said undamaged surface leading to said rectangular area.

4. The method as defined in claim 3 wherein the length of each of said blades is equal to the width of a tile.

5. The method as defined in claim 4 wherein the width and the length of said rectangular area each is an even mutliple of the respective width and length of a tile.

6. The method as defined in claim 5 wherein only those blades encompassing the width of said rectangular area have their lower edges conformed in step (c).

7. The method of claim 3 wherein the step of removing the undamaged surface of the runway surrounding the damage creates side edges defining said rectangular area, said tiles being laid such that the outwardly facing portions of the outermost tiles are contiguous with said side edges.

8. Apparatus for effecting rapid repair of crater-damaged aircraft runway surfaces, which comprises an elongate carrier, movable support means at each end of said carrier for moving the carrier in a direction transverse to the longitudinal axis of the carrier, each movable support means comprising a first set of wheels connected by a first beam and a second set of wheels connected by a second beam, means for rocking said beams independently about an axis perpendicular to the length of said carriage and parallel with said direction, adjusting means carried by said support means for raising and lowering each end of the carrier with respect to the surface upon which said movable support means rest, a plurality of strike-off blades disposed in end-to-end relation and pairs of position adjusting means carried by said carrier for independently raising and lowering each end of each blade, and guide means for maintaining said blades in end-to-end relation, each of said strike-off blades being separate from and completely independently adjustable with respect to all the other blades, each of said blades having a pair of spaced substantially vertical slots formed therethrough, said guide means including a plurality of guide members extending loosely through said slots so that the plates can move a substantial distance in a vertical direction and also a limited amount rotationally with respect to said guide members so as to allow the composite strike-off edge defined by such blades to conform to the contour of the undamaged runway surface.

9. Apparatus according to claim 8 wherein said adjusting means of each pair comprise a rotationally drivable, substantially vertical, screwthread spindle which is so supported by the carrier as to be freely rotatable but to remain axially stationary with respect thereto and which carries a nut member secured to its associated strike-off blade.

10. Apparatus according to claim 9 wherein the screwthread spindle carries a hand-operable drive wheel and/or crank secured to its top end which protrudes above the carrier.

11. Apparatus according to claim 8 wherein each strike-off blade has associated therewith a deflector plate extending at or near the top thereof and adapted to deflect fill material collecting at the front side of the blades into the direction of movement of the apparatus.

12. Apparatus according to claim 8 wherein each strike-off blade is deflected in the normal moving direction of the apparatus at its top portion.

13. Apparatus as defined in claim 8 including indicating means at each of said support means for determining the height of said carrier with respect thereto.

14. Apparatus as defined in claim 8 wherein each of said strike-off blades is of a predetermined length equal to the width of a tile to be laid over the depressed contour.

* * * * *